US005799235A

United States Patent [19]

Nakano et al.

[11] Patent Number: 5,799,235

[45] Date of Patent: Aug. 25, 1998

[54] ELECTROPHOTOGRAPHIC APPARATUS HAVING AN INTERMEDIATE TRANSFER DEVICE AND REGISTRATION CONTROLLING METHODS THEREFOR

[75] Inventors: Masaru Nakano, Tsukuba; Masafumi Suzaki, Hitachi; Tetsuro Akasaki, Hitachinaka; Masahiko Saito, Kitaibaraki, all of Japan

[73] Assignee: Hitachi, Ltd., Tokyo, Japan

[21] Appl. No.: 375,668

[22] Filed: Jan. 20, 1995

Related U.S. Application Data

[63] Continuation-in-part of Ser. No. 227,336, Apr. 14, 1994.

[30] Foreign Application Priority Data

Jan. 20, 1994 [JP] Japan ..... 6-004411

[51] Int. Cl.[6] ..... G03G 21/00; G03G 21/14

[52] U.S. Cl. ..... 399/302; 399/308; 399/71

[58] Field of Search ..... 355/271, 272, 355/274, 275, 326 R; 399/302, 308, 71

[56] References Cited

U.S. PATENT DOCUMENTS

| | | | |
|---|---|---|---|
| 4,126,388 | 11/1978 | Kawai | 355/217 |
| 4,609,281 | 9/1986 | Miyai et al. | 355/210 |
| 4,788,572 | 11/1988 | Slayton et al. | 355/317 |
| 4,899,196 | 2/1990 | Mahoney | 355/271 |
| 5,049,946 | 9/1991 | Harada | 355/309 |
| 5,084,735 | 1/1992 | Rimai et al. | 355/271 |
| 5,099,286 | 3/1992 | Nishise et al. | 355/272 |
| 5,107,303 | 4/1992 | Miyamoto et al. | 355/296 |
| 5,122,842 | 6/1992 | Rimai et al. | 355/326 R |
| 5,138,363 | 8/1992 | Yuge | 355/275 X |
| 5,140,379 | 8/1992 | Johnson | 355/317 |
| 5,173,735 | 12/1992 | Kusumoto | 355/271 |
| 5,177,543 | 1/1993 | Rodenberg et al. | 355/271 |
| 5,196,893 | 3/1993 | Nishise et al. | 355/271 |
| 5,247,337 | 9/1993 | Malachowski | 355/308 |
| 5,258,816 | 11/1993 | Haneda | 355/210 X |
| 5,270,783 | 12/1993 | Bisaiji et al. | 355/208 X |
| 5,321,475 | 6/1994 | Horiuchi et al. | 355/253 |
| 5,327,199 | 7/1994 | Sekine | 355/326 R |
| 5,390,010 | 2/1995 | Yamahata | 355/271 |

FOREIGN PATENT DOCUMENTS

| | | |
|---|---|---|
| 3-106736 | 5/1991 | Japan . |
| 3-77941 | 8/1991 | Japan . |
| 4-326373 | 11/1992 | Japan . |

*Primary Examiner*—R. L. Moses

*Attorney, Agent, or Firm*—Antonelli, Terry, Stout & Kraus, LLP

[57] ABSTRACT

Registration controlling methods are provided for a color electrophotographic apparatus capable of forming an image without color registration errors and uneven color. This is accomplished by preventing a photosensitive medium from being undesirably moved in the direction perpendicular to the transportation direction caused by an electrostatic attractive force between the photosensitive medium and an intermediate transfer device, even if there is a twist between the fixed axis of the member supporting the photosensitive medium and the axis of the member supporting the intermediate transfer device. With these methods, a fur brush cleaner made of a conductive brush is detached from the intermediate transfer device during the time period after the start of driving the photosensitive medium and until the front edge of the photosensitive medium reaches the intermediate transfer device. A small amount of toner therefore always exists between the intermediate transfer device and the photosensitive medium during the transportation of the photosensitive medium, thereby reducing the electrostatic attractive force between the intermediate transfer device and the photosensitive medium and preventing the photosensitive medium from being undesirably moved in the direction perpendicular to the transportation direction. Also during this time period, the photosensitive medium is irradiated by a fade lamp to reduce electric charges on the photosensitive medium.

8 Claims, 11 Drawing Sheets

ELECTROPHOTOGRAPHIC APPARATUS HAVING AN INTERMEDIATE TRANSFER DEVICE AND REGISTRATION CONTROLLING METHODS THEREFOR

CROSS-REFERENCE TO RELATED APPLICATIONS

This is a continuation-in-part of application U.S. Ser. No. 08/227,336 filed Apr. 14, 1994 entitled "COLOR ELECTRO-PHOTOGRAPHIC APPARATUS". The disclosure of this application is incorporated herein by reference.

BACKGROUND OF THE INVENTION

1. Field of the Invention

The present invention relates to a color electrophotographic apparatus, and more particularly to a color laser printer for producing a color image by forming superposed different color toner images on an intermediate transfer device which is disposed so as to make a partial area thereof contact a belt type photosensitive medium.

2. Description of the Related Art

A laser printer produces a color image by using an electrophotography technique and performing the following processes. The surface of a drum or belt type photosensitive medium is uniformly charged, an electrostatic latent image is formed by irradiating a laser beam on the surface of the photosensitive medium, the electrostatic latent image is developed to form a toner image, the toner image is temporarily transferred to an intermediate transfer device, the above processes are repeated for different color toner images to transfer color toner images to the intermediate transfer device, and the color toner images are then transferred to a recording medium and fixed on the recording medium by a fixing unit to produce a final color image. A color laser printer having such a function is disclosed in U.S. Pat. Ser. No. 08/227,336.

During the above processes, a cleaner contacts the intermediate transfer device to remove residual toner on the intermediate transfer device and to produce a clear image without uneven color, before each toner image is transferred from the photosensitive medium and after all the toner images are transferred to a recording medium. The cleaner is made of an electrically conductive brush.

If there is a twist between the fixed axis for supporting a belt type photosensitive medium and the axis for supporting a drum type intermediate transfer device, respectively of a laser printer, an undesirable conveying force is applied to the photosensitive medium and the intermediate transfer device in the axial direction because of an electrostatic attractive force between the photosensitive medium and the intermediate transfer device. Therefore, immediately after the belt type photosensitive medium movable in the axial direction is driven, it is moved or displaced in the direction perpendicular to the transportation or conveying direction of the photosensitive medium. This displacement cannot be eliminated completely by a physical compensation device such as a regulating plate, because the belt type photosensitive medium is not rigid. During the production of a color image by superposing a plurality color of toner images, this belt displacement lowers the color registration precision and can generate a color registration error.

To solve this problem, a registration controlling method has been proposed as disclosed in JP-A-3-106736. According to this method, the endless belt displacement to be generated immediately after the start of driving the belt is suppressed by releasing the tension of the belt.

With this conventional technique, however, releasing the belt tension reduces the grip force between the belt and a driving roller, resulting in uneven conveying. In addition, it is unable to completely eliminate the belt displacement in the direction perpendicular to the transportation direction which is caused by a twist between the fixed axis for supporting the photosensitive medium and the axis for supporting the intermediate transfer device.

SUMMARY OF THE INVENTION

The invention has been made in order to solve the above-described problems associated with the conventional techniques. The object of the invention is to provide a registration controlling method and a color electrophotographic apparatus capable of eliminating an undesirable displacement of a photosensitive medium in the direction perpendicular to the transportation direction thereby producing a clear color image without color registration errors and uneven color, even if there is a substantial twist between the fixed axis for supporting the photosensitive medium and the axis for supporting an intermediate transfer device.

The above object can be achieved through the provision of a registration controlling method for a color electrophotographic apparatus, including the steps of: charging a belt type photosensitive medium by an electrostatic charger; forming an electrostatic latent image on the photosensitive medium by an exposure device; transforming the electrostatic latent image into a toner image by a developer; transferring the toner image to an intermediate transfer device; repeating the steps recited above for a plurality color of toner images; transferring a color toner image formed on the intermediate transfer device to a recording medium; fixing the transferred toner image on the recording medium by a fixing device; and ejecting the recording medium out of the apparatus, wherein the photosensitive medium is subjected to exposure by a pre-exposure device and a cleaner for removing toner on the intermediate transfer device is made inoperable, during the time period after the start of driving the photosensitive medium and until the front edge of the toner image formed on the photosensitive medium reaches the intermediate transfer device. In this case, the front edge of the toner image may correspond to the front end of the region in which a toner image formation is possible. Alternatively, the front edge of the toner image may coincide with a top of a toner image where visible toner image really exist.

During the time period the photosensitive medium may be subjected to exposure by the pre-exposure device and the operation of the cleaner may be prohibited for a time period required for the intermediate transfer device to rotate at least once or more before the front edge of the toner image reaches the intermediate transfer device.

The photosensitive medium may be subjected to exposure by the pre-exposure device during the time period after the start of driving the photosensitive medium and until the front edge of the toner image formed on the photosensitive medium reaches the intermediate transfer device, and the cleaner may be made operable during the time period after the front edge of the toner image reaches the intermediate transfer device and until the front edge reaches the operating point of the cleaner relative to the intermediate transfer device.

The cleaner for removing toner on the intermediate transfer device may be made inoperable, during the time period after the start of driving the photosensitive medium and until the front edge of the toner image formed on the photosensitive medium reaches the intermediate transfer device.

During the time period after the start of driving the photosensitive medium and until the front edge of the toner image formed on the photosensitive medium reaches the intermediate transfer device, the operation of the cleaner for removing toner on the intermediate transfer device may be prohibited for a time period required for the intermediate transfer device to rotate at least once or more before the front edge of the toner image reaches the intermediate transfer device.

During the time period after the start of driving the photosensitive medium and until the front edge of the toner image formed on the photosensitive medium reaches the intermediate transfer device, the cleaner for removing toner on the intermediate transfer device may be made operable during the time period after the front edge of the toner image reaches the intermediate transfer device and until the front edge reaches the operating point of the cleaner relative to the intermediate transfer device.

During the time period after the start of driving the photosensitive medium and until the front edge of the toner image formed on the photosensitive medium reaches the intermediate transfer device, the photosensitive medium may be subjected to exposure by a pre-exposure device.

According to the present invention, the cleaner is not applied to the intermediate transfer device until the front edge of a toner image is transferred from the photosensitive medium to the intermediate transfer device. As a result, a small amount of toner exists between the photosensitive medium and the intermediate transfer device to the extent that such toner does not form a visible color image on a recording medium. A space corresponding to the diameter of a toner particle is therefore formed between the photosensitive medium and the intermediate transfer device. Since the electrostatic capacitance between the surfaces of the photosensitive medium and the intermediate transfer device reduces in proportion with the size of the space, the electrostatic attractive force is reduced. The electrostatic attractive force is further reduced when the photosensitive medium is subjected to exposure by the pre-exposure device to reduce electric charge on the medium. As a result, even if there is a twist between the fixed axis for supporting the photosensitive medium and the axis for supporting the intermediate transfer device, the transportation force of the photosensitive medium and the intermediate transfer device in the axial direction thereof is reduced so that the displacement of the photosensitive medium in the direction perpendicular to the transportation direction becomes small. A clear image without a color registration error and uneven color can therefore be produced.

If the intermediate transfer device is not cleaned at all before a toner image is transferred, a clear image may not be produced because some amount of toner may be attached to the intermediate transfer device during the shut-off period of the apparatus. This problem can be solved by terminating cleaning of the intermediate transfer device during the time required for the intermediate transfer device to rotate at least once or more before the front edge of the toner image reaches the intermediate transfer device.

Alternatively, the operation of the cleaner may be continued during the time period after the start of transfer and until the front edge of the toner image reaches the position where the cleaner is applied to the intermediate transfer device. Since the toner image is transferred to the intermediate transfer device during the cleaning, a sufficiently small amount of toner is still resident between the photosensitive medium and the intermediate transfer device so that the same effects as discussed above are ensured.

As described above, the effects of reducing an electrostatic attractive force can be obtained by a method of supplying a small amount of toner between the photosensitive medium and the intermediate transfer device until the toner image is transferred to the intermediate transfer device, to the extent that such toner does not form a visible color image, or by a method of reducing electric charges on the photosensitive medium by the pre-exposure device. Both the methods may be used to have the considerably large effects, or one of the methods may also be used.

DESCRIPTION OF THE PREFERRED EMBODIMENTS

Embodiments of the invention will be described with reference to the accompanying drawings.

Figure 1:
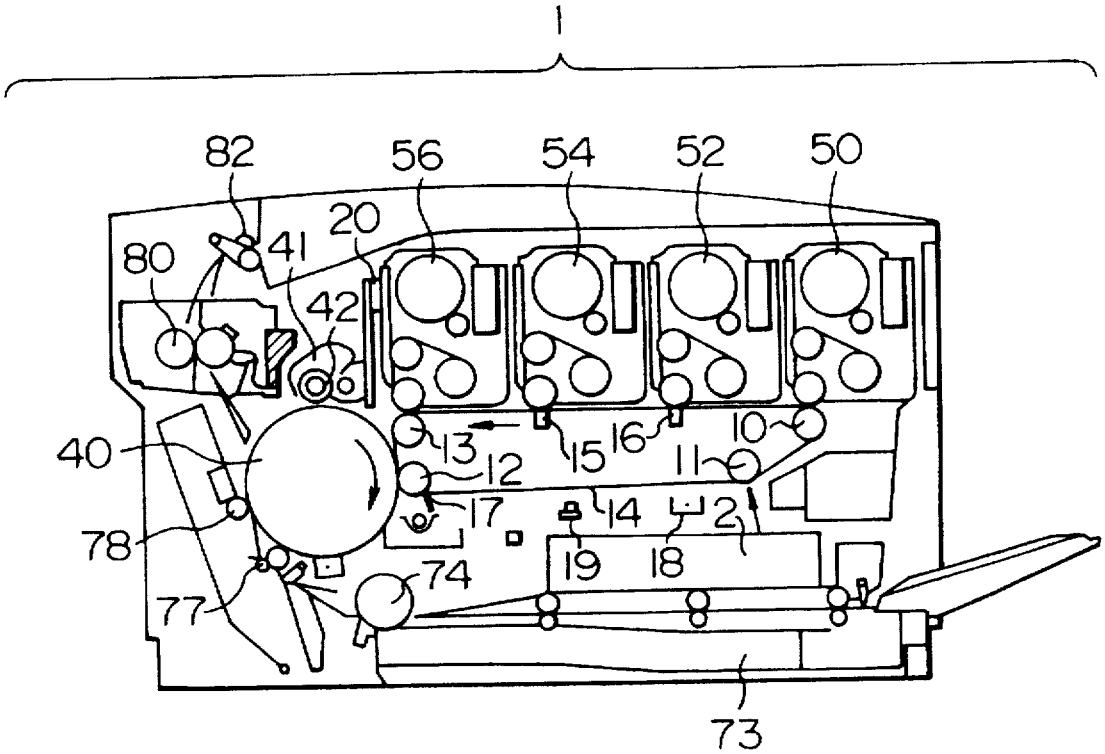
FIG. 1 is a cross sectional view of a color electrophotographic apparatus according to the invention.

FIG. 1 shows the structure of a color laser printer 1 according to an embodiment of the invention.

The color laser printer 1 of this embodiment includes a belt type photosensitive medium 14 extended between a drive roller 10, driven rollers 11 and 12, and a tension roller 13 and rotating at a constant speed in the direction indicated by an arrow, a transfer drum 40 which is disposed so as to make a partial area thereof contact the photosensitive medium, a charger 18 for uniformly charging the surface of the photosensitive medium, an exposure device 2 for subjected the surface of the uniformly charged photosensitive medium 14 to exposure and forming an electrostatic latent image on the surface of the photosensitive medium 14, four developers 50, 52, 54, and 56 each for developing the latent image formed on the surface of the photosensitive medium 14 and forming a toner image, stays 15 and 16 for maintaining a distance between the photosensitive medium 14 and the developers 52 and 54 constant, a transfer roller 78 for transferring the toner image to a recording medium such as a recording paper, a fuser 80 for fixing the toner image transferred to the recording medium, a blade 17 for removing residual toner on the surface of the photosensitive medium 14 after the toner images have been transferred to the transfer drum 40, an erase lamp 19 for removing residual electric charges on the surface of the photosensitive medium 14 after the toner images have been transferred to the transfer drum 40, and a conductive fur brush cleaner 41 for removing residual toner on the surface of the transfer drum 40.

The exposure device 2 applies a laser beam on the surface of the photosensitive medium 14 in accordance with video data sent from an external information processing system (not shown).

The developers 50, 52, 54, and 56 include yellow, magenta, cyan, and black toner. A bias voltage is applied to each developer to attach toner to the photosensitive medium.

Processes of recording a color image by using this apparatus will be described. First, conventional color image recording processes will be described.

An electrostatic latent image corresponding to a yellow toner image is formed on the photosensitive medium 14 by the exposuring device 2. The toner image developed by the yellow developer 50 is transferred to the surface of the transfer drum 40 at the contact area thereof with the photosensitive medium.

Residual toner on the surface of the photosensitive medium 14 is removed by the blade 17. For the preparation of the next developing process, residual electric charges on the surface of the photosensitive medium 14 are also removed by the erase lamp 19.

With similar processes as above, magenta, cyan, and black toner images superposed upon the yellow toner image are transferred to the surface of the transfer drum 40.

Next, a paper feed roller 74 is rotated to pick up a sheet of paper 73 accommodated in a cassette. The feed roller 74 is rotated until the front end of the paper abuts on a registration roller 66 and a slanted paper alignment, if any, is corrected.

Next, the registration roller 66 is rotated at the timing of aligning the front edge of the toner images with the front end of the paper. After the front end of the paper under transportation contacts the transfer drum 40, a transfer roller 78 is pressed against the back surface of the paper to transfer the toner images on the transfer drum 40 to the paper.

The paper with the color toner images transferred thereto in the manner described above is passed between a heating roller and a pressing roller of the fuser 80 to fix the color toner images, and ejected out of the apparatus by an eject roller 82.

After the toner images have been transferred to the paper, the fur brush cleaner 41 for removing residual toner on the transfer drum 40 is driven to contact the surface of the transfer drum 40. After the residual toner on the surface of the transfer drum 40 has been removed, the next image forming processes start.

Figure 2:
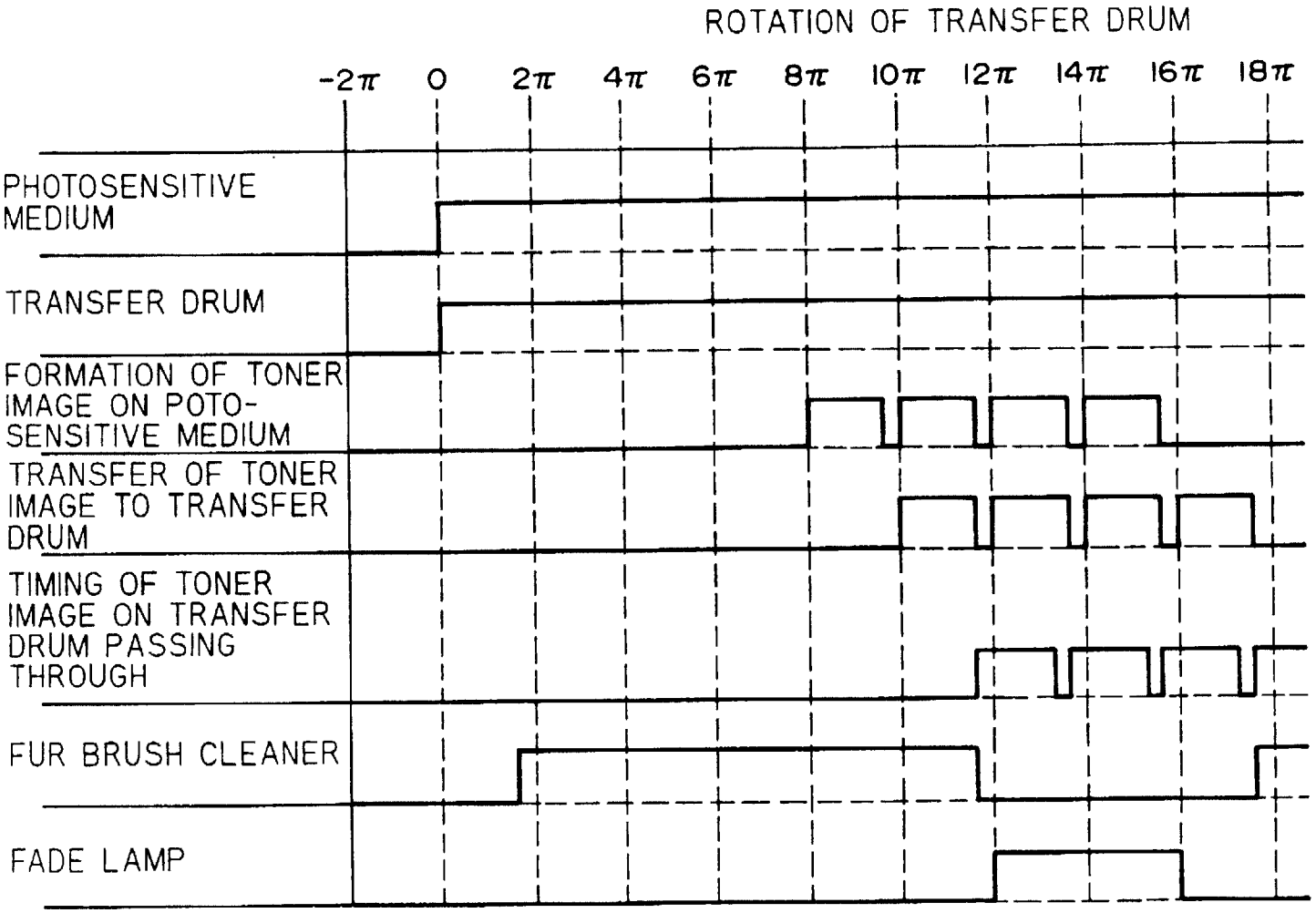
FIG. 2 PRIOR ART
FIG. 2 is a timing chart explaining the operation of a conventional apparatus.

FIG. 2 illustrates the timings of the conventional image forming processes to be performed by each constituent element of the apparatus. In FIG. 2, a rise-up of each line corresponds to an operation start, and a fall-down corresponds to an operation end. The abscissa corresponds to a rotation angle of the transfer drum, represented by the unit of radian. 2 $\pi$ corresponds to one rotation of the transfer drum 40.

When an image forming operation starts, a yellow toner image is transferred to the transfer drum 40. Until the front edge of the toner image reaches the operation point 42 of the fur brush cleaner 41 relative to the drum, the cleaner 41 is driven to remove toner attached to the surface of the transfer drum 40, thereby preventing an image from having uneven color.

Before the magenta and cyan toner images formed on the photosensitive medium 14 are transferred to the transfer drum 40, these images are subjected to exposure by a fade lamp 20 to remove electric charges on the photosensitive medium 14, thereby facilitating to transfer the toner images to the transfer drum 40.

If there is some twist between the center axes of the photosensitive medium driven roller 12 and the transfer drum 40 respectively supported on the housing of the printer 1, a transportation force of the photosensitive medium 40 is generated in the direction perpendicular to the transportation direction, in proportion to the quantity of the twist. This transportation force becomes greater as the electrostatic attractive force between the photosensitive medium 14 and the transfer drum 40 becomes larger. A transportation force is therefore generated at the photosensitive medium 14 and the transfer drum 40 in the axial direction thereof. Although the transfer drum 40 will not be moved by this force because the motion thereof is restricted in the axial direction, the photosensitive medium 14 is moved slightly in the direction perpendicular to the transportation direction because the motion thereof is not restricted in the former direction.

The fur brush cleaner 41 is driven to remove toner on the transfer drum 40 after the photosensitive medium 14 is moved and until the front edge of the yellow toner image reaches the operation point 42 of the fur brush cleaner 41. During this period, no toner exists between the transfer drum 40 and the photosensitive medium 14 so that the electrostatic attractive force therebetween is very large. A large transportation force is therefore exerted to the photosensitive medium 14 in the direction perpendicular to the transportation direction. As a result, the photosensitive medium 14 is greatly displaced in the direction perpendicular to the transportation direction before the yellow toner image is transferred to the transfer drum 40. The displaced photosensitive medium 14 gradually restores the original position by a belt displacement correcting unit (not shown) while the magenta, cyan, and black toner images are transferred. Each color toner image is therefore formed at a different area on the transfer drum 40, resulting in a color registration error.

It is necessary to eliminate a twist between the center axes of the driven roller 12 and the transfer drum 40 so as to solve the problem of a color registration error. However, this is practically difficult from the manufacturing viewpoint.

Figure 3:
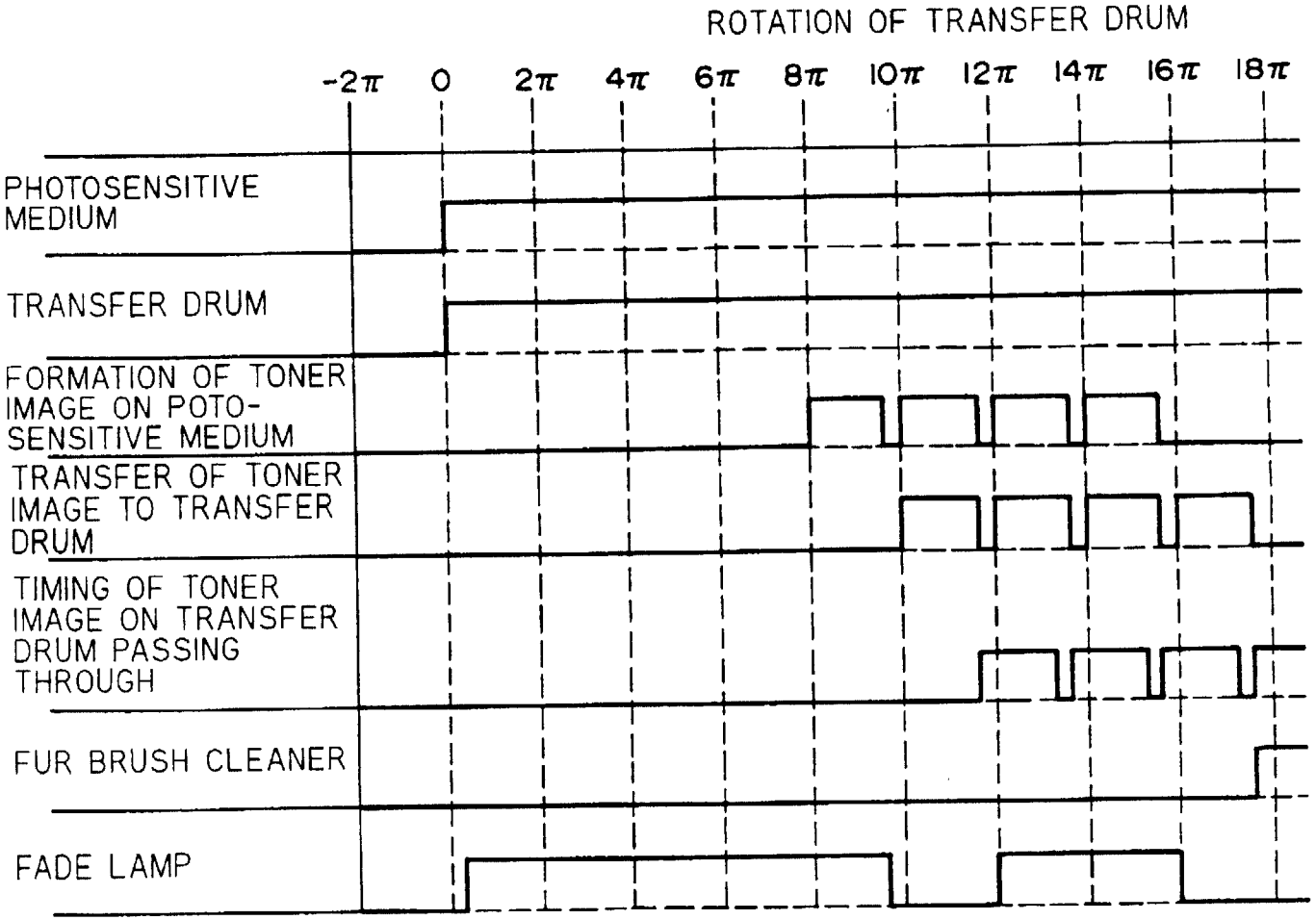
FIG. 3 is a timing chart explaining the operation of a color electrophotographic apparatus according to one embodiment of the invention.

FIG. 3 is a timing chart explaining one example of the registration controlling method of the invention wherein a transportation force exerted to the photosensitive medium 14 in the direction perpendicular to the transportation direction is reduced while even allowing a twist more or less. With this method, the fade lamp 20 is maintained to exposure the photosensitive medium 14 and the fur brush cleaner 41 is maintained to be detached from the transfer drum 40, until the yellow toner image is transferred from the photosensitive medium 14 to the transfer drum 40.

Since light 21 (refer to FIG. 4) is radiated from the fade lamp 20 until the yellow toner image is transferred to the transfer drum 40, electric charges on the photosensitive medium 14 are removed. As a result, the electrostatic attractive force between the photosensitive medium 14 and the transfer drum 40 is reduced so that the photosensitive medium 14 is prevented from being moved in the direction perpendicular to the transportation direction of the photosensitive medium 14.

Figure 4:
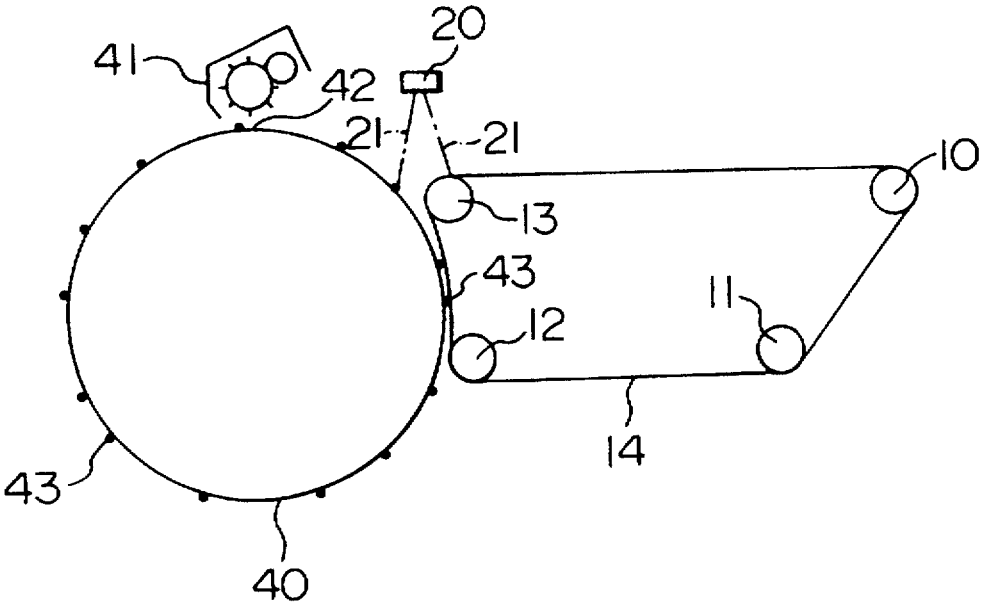
FIG. 4 is a diagram showing the contact state between a transfer drum and a photosensitive medium according to the invention.

Furthermore, as shown in FIG. 4, since the fur brush cleaner 41 is detached from the transfer drum 40, a small amount of toner 43 is resident on the transfer drum 40. This small amount of toner 43 forms a fine space between the photosensitive medium 14 and the transfer drum 40 so that an electrostatic attractive force therebetween is reduced. The larger the space, the smaller the electrostatic attractive force between the photosensitive medium 14 and the transfer drum 40 because of a smaller electrostatic capacitance of the space. In the above manner, it becomes possible to prevent the photosensitive medium 14 from being moved immediately after the start-up in the direction perpendicular to the transportation direction, by using the fade lamp 20 and the fur brush cleaner 41.

If a toner image is formed on the photosensitive medium 14 after the printer 1 has not been used for a long period, and if the fur brush cleaner 41 is detached from the transfer drum 40 until the yellow toner image is transferred to the transfer drum 40, an uneven image may be formed in some times because of toner dropped from the developers or the like by vibrations of the printer 1 and attached to the transfer drum 40. In such a case, it becomes necessary to contact the fur brush cleaner 41 with the transfer drum 40 to clean it at least for the period corresponding to one revolution of the transfer drum 40, before the yellow toner image is transferred to the transfer drum 40.

Figure 5:
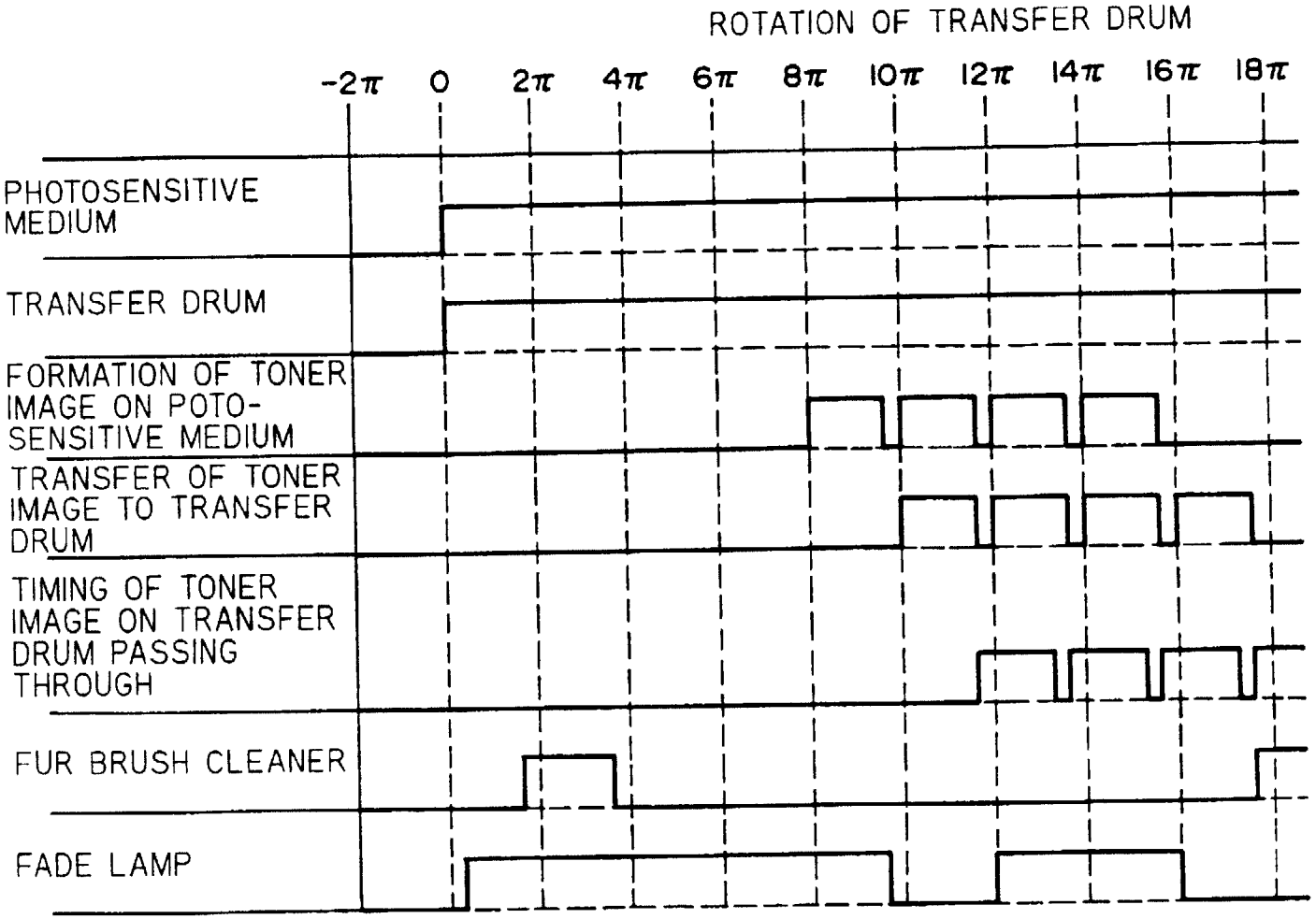
FIG. 5 is a timing chart explaining the operation of a color electrophotographic apparatus according to another embodiment of the invention.

For this purpose, as shown in FIG. 5, the fade lamp 20 is maintained to expose the photosensitive medium 14 until the yellow toner image is transferred from the photosensitive medium 14 to the transfer drum 40, whereas the fur brush cleaner 41 is made in contact with the transfer drum 40 at least for the period corresponding to one revolution of the transfer drum 40, before the yellow toner image is transferred to the transfer drum 40.

Since the fade lamp 20 exposes the photosensitive medium, an electrostatic attractive force between the photosensitive medium 14 and the transfer drum 40 is reduced, and since the fur brush cleaner 41 is detached from the transfer drum 40 until the yellow toner image is transferred to the transfer drum, a small amount of toner is resident on the transfer drum 40. Accordingly, an electrostatic attractive force between the photosensitive medium 14 and the transfer drum 40 is reduced and the photosensitive medium 14 is prevented from being moved in the direction perpendicular to the transportation direction. If the fur brush cleaner 41 is detached from the transfer drum 40 so as not clean it for the period corresponding to two revolutions of the transfer drum 40, before the yellow toner image on the photosensitive medium 14 is transferred to the transfer drum 40, then a residual amount of toner increases enhancing the effects of reducing an electrostatic attractive force.

Figure 6:
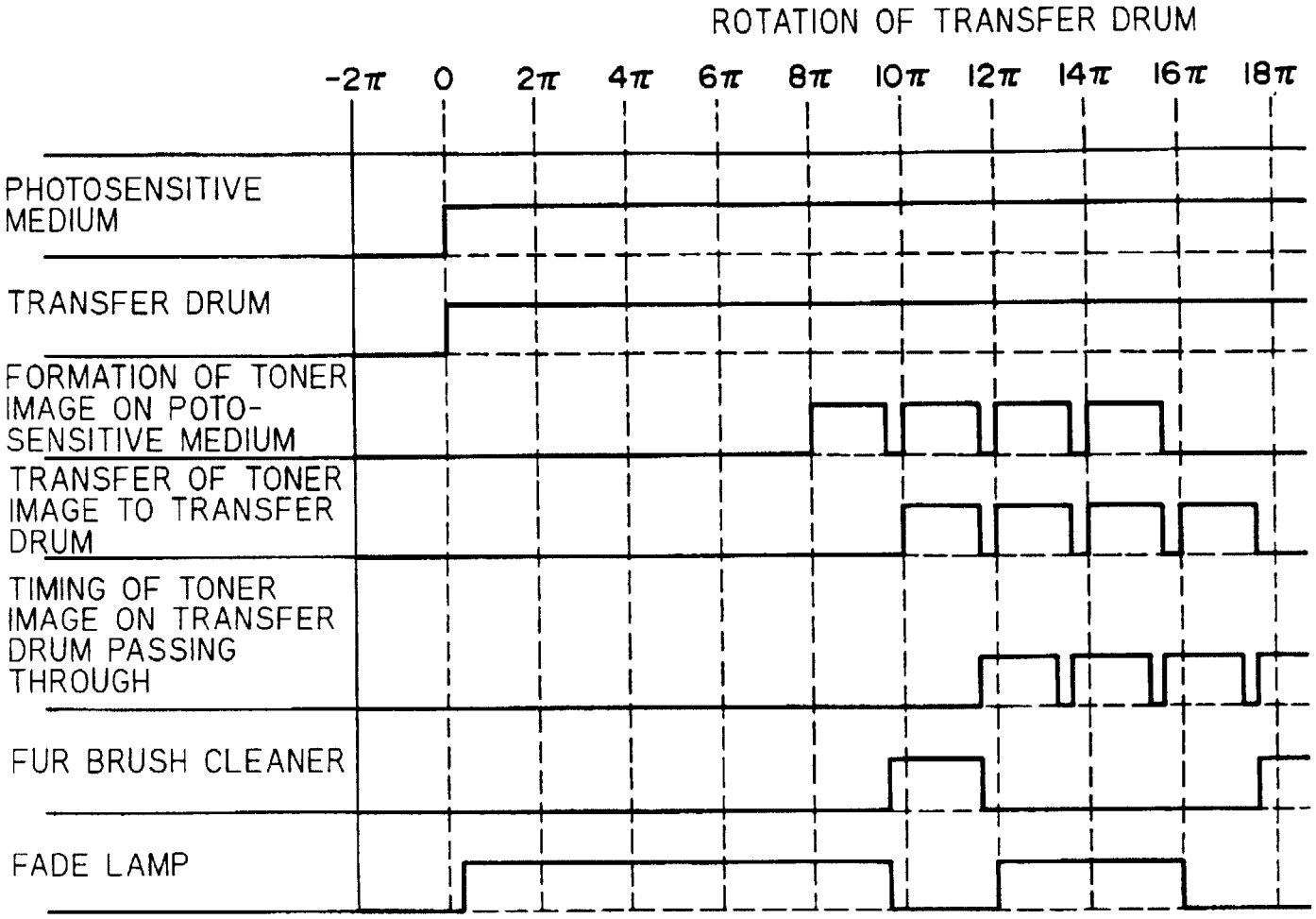
FIG. 6 is a timing chart explaining the operation of a color electrophotographic apparatus according to still another embodiment of the invention.

In the case shown in FIG. 6, the fade lamp 20 is maintained to expose the photosensitive medium 14 until the yellow toner image is transferred from the photosensitive medium 14 to the transfer drum 40, whereas the fur brush cleaner 41 is made in contact with the transfer drum 40 for the period corresponding to one revolution of the transfer drum 40, after the front edge of the yellow toner image is transferred to the transfer drum 40 and the yellow toner image reaches the operating point 42 of the fur brush cleaner 41.

Since the fur brush cleaner 41 is detached from the transfer drum 40 until the yellow toner image is transferred to the transfer drum 40, a small amount of toner is resident on the transfer drum 40, and since the yellow toner image is transferred to the transfer drum 40 generally at the same time when the fur brush cleaner 41 is operated, a sufficiently small amount of toner is still resident between the photosensitive medium 14 and the transfer drum 40, reducing an electrostatic attractive force therebetween and preventing the photosensitive medium 14 from being moved in the direction perpendicular to the transportation direction.

Figure 7:
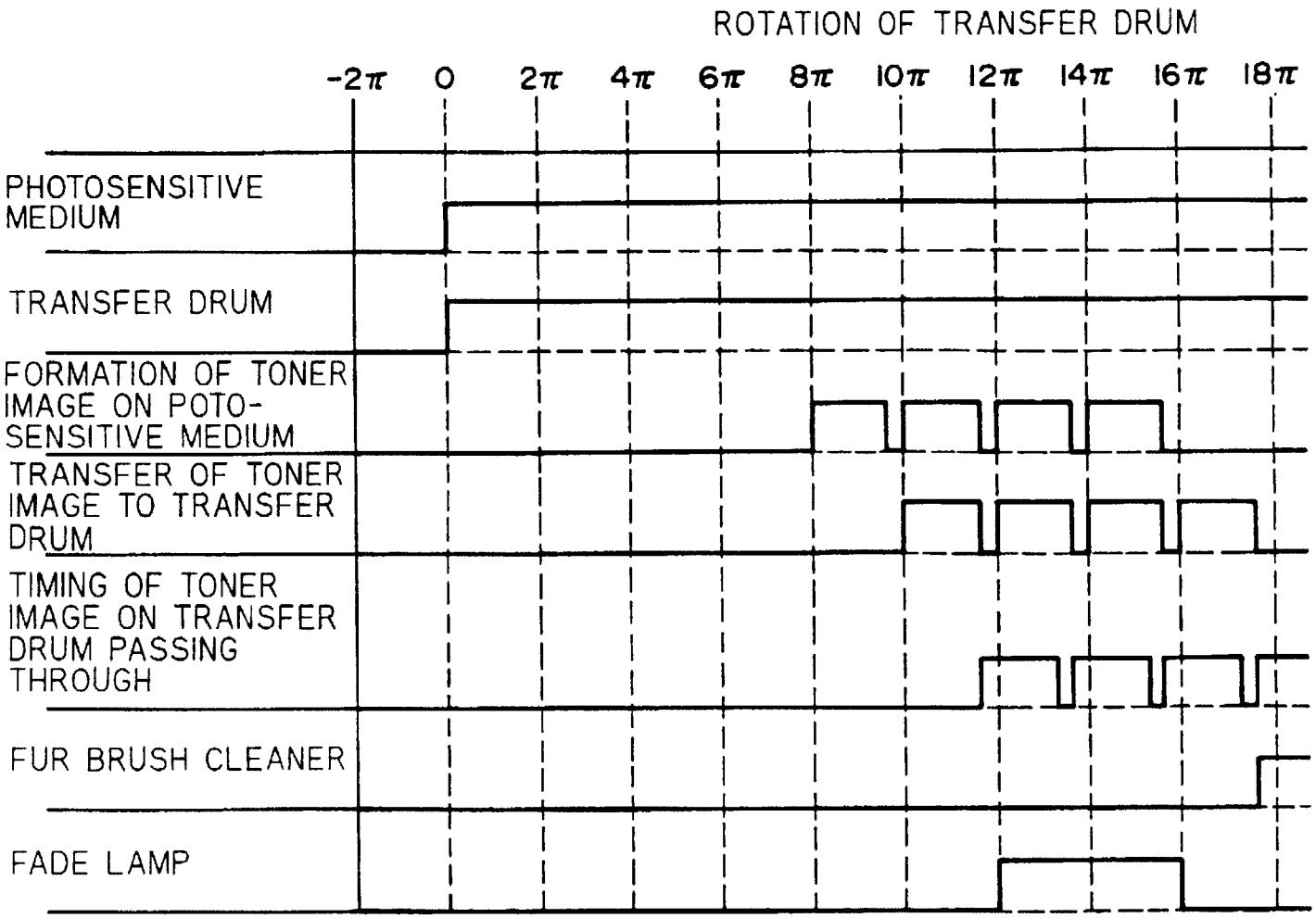
FIG. 7 is a timing chart explaining the operation of a color electrophotographic apparatus according to a further embodiment of the invention.
Figure 8:
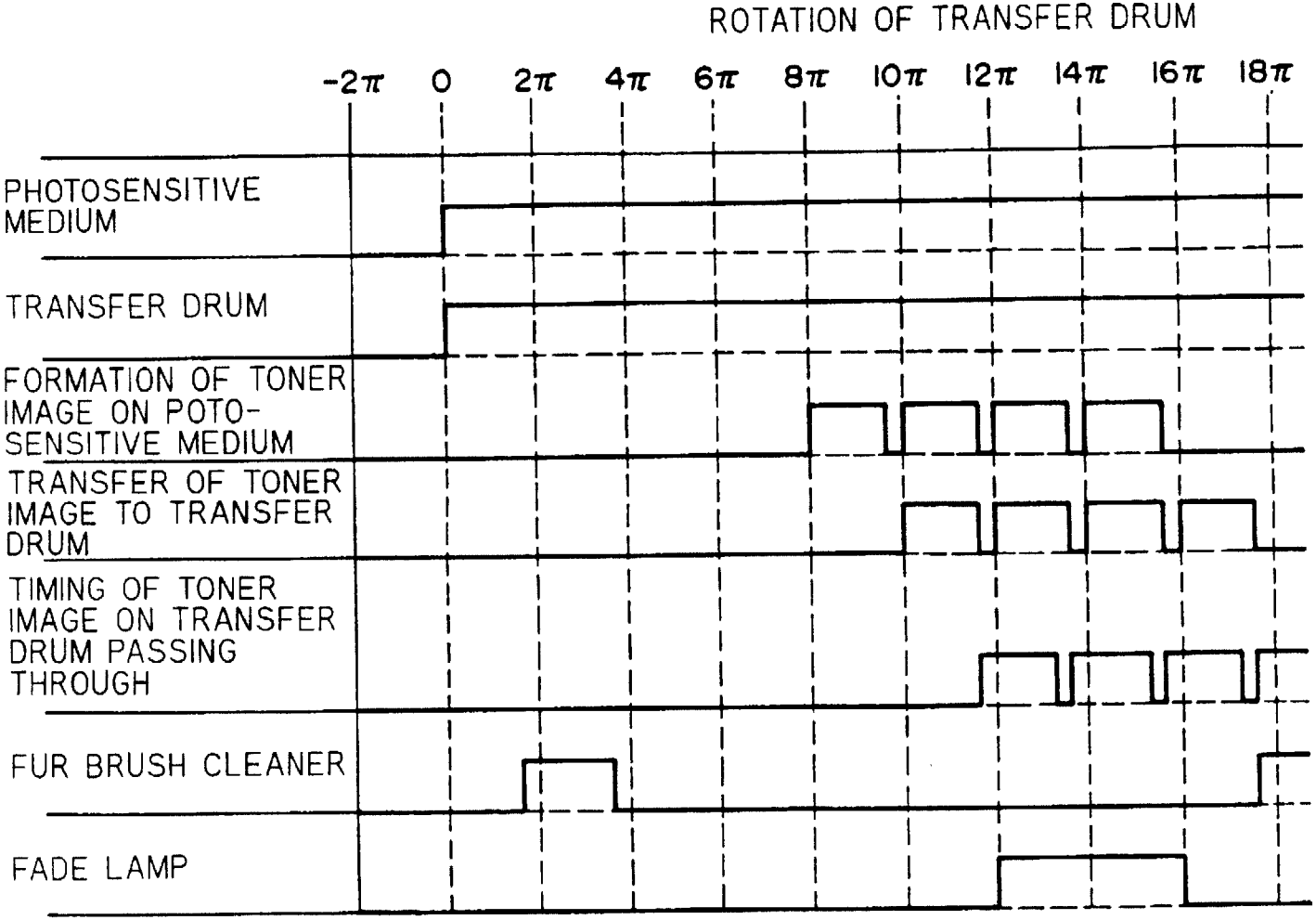
FIG. 8 is a timing chart explaining the operation of a color electrophotographic apparatus according to another embodiment of the invention.
Figure 9:
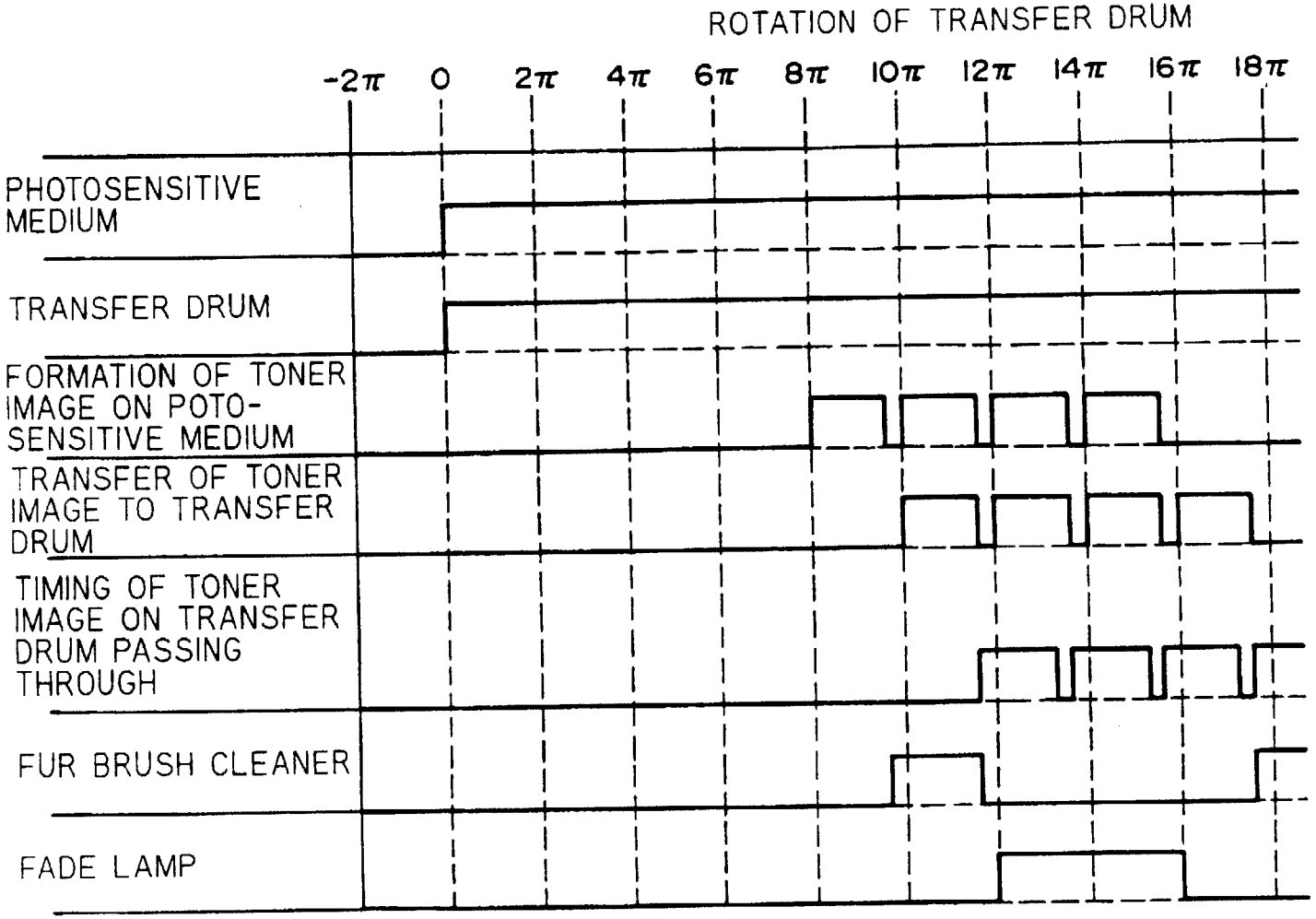
FIG. 9 is a timing chart explaining the operation of a color electrophotographic apparatus according to still another embodiment of the invention.

The timing charts shown in FIGS. 7, 8, and 9 illustrate the methods of preventing the photosensitive medium 14 from being moved by using only the operation control of the fur brush cleaner 41 without the help of the fade lamp 20.

Even if electric charges on the surface of the photosensitive medium 14 are not removed by exposing the photosensitive medium 14 by the fade lamp 20, an electrostatic attractive force between the photosensitive medium 14 and the transfer drum 40 can be reduced and the photosensitive medium 14 can be prevented from being moved in the direction perpendicular to the transportation direction, by making a small amount of toner exist between the photosensitive medium 14 and the transfer drum 40.

Figure 10:
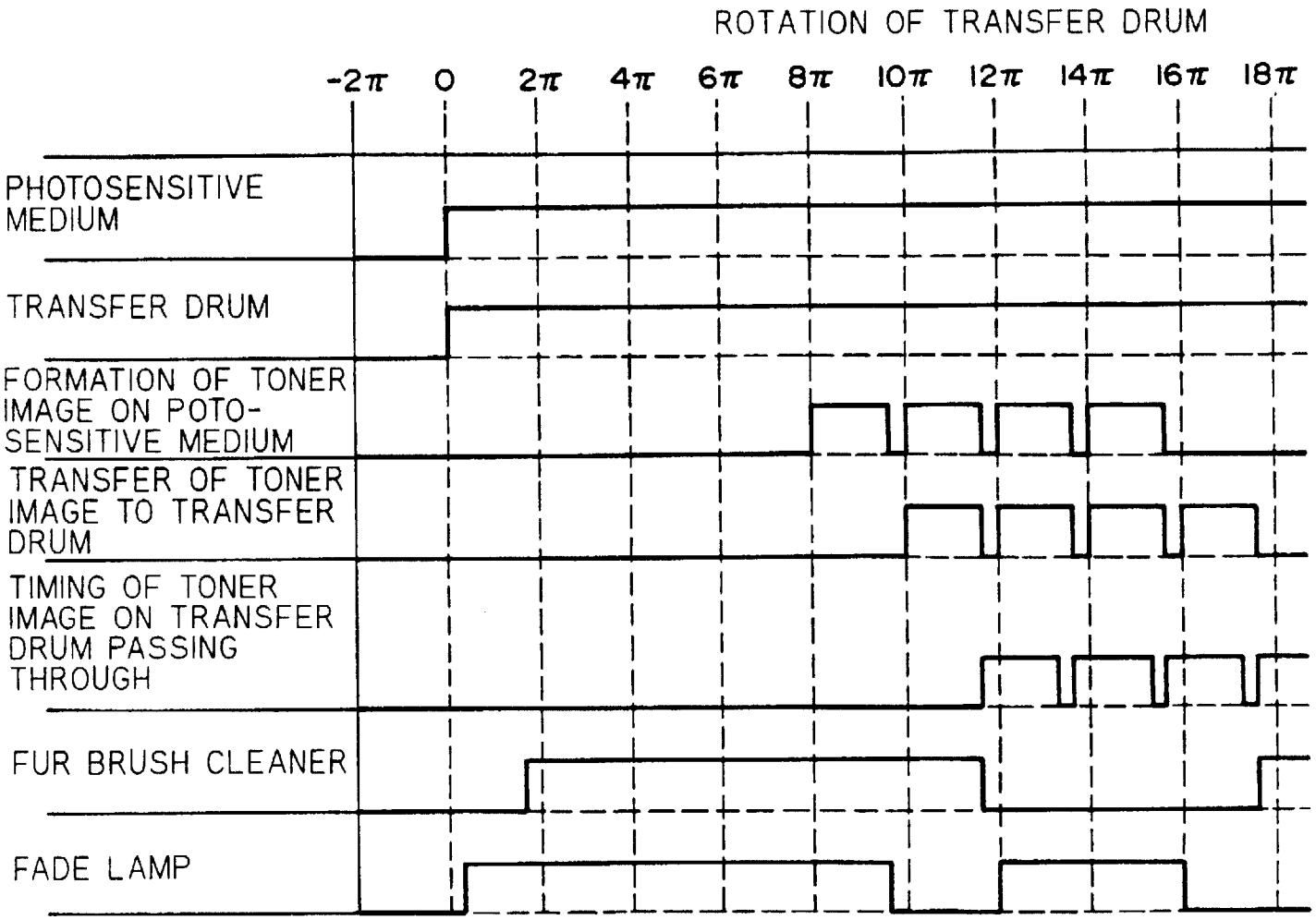
FIG. 10 is a timing chart explaining the operation of a color electrophotographic apparatus according to a further embodiment of the invention.

The timing chart shown in FIG. 10 illustrates another method in which the fur brush cleaner 14 is operated in the manner similar to a conventional operation and only the fade lamp 20 is used for reducing an electrostatic attractive force.

Figure 11:
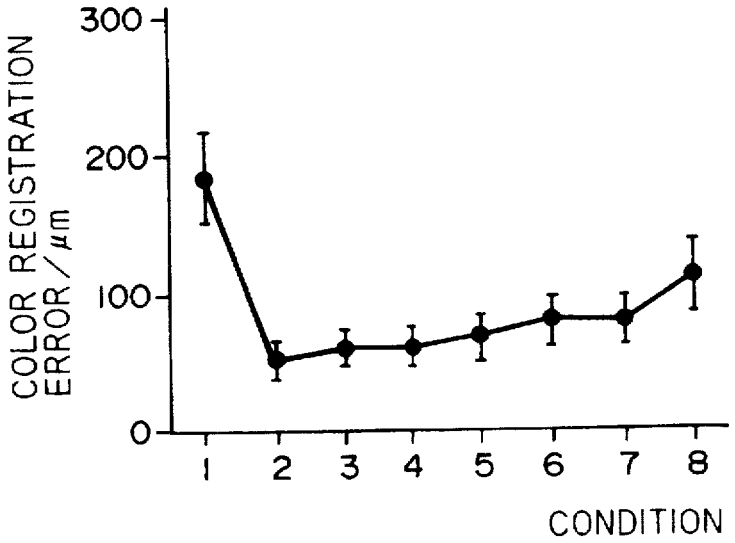
FIG. 11 is a diagram explaining the effects of reducing a color registration error according to the invention.

The degree of a color registration error as a result of the registration control by each of the above-described methods is shown in FIG. 11.

In FIG. 11, the condition 1 corresponds to the method explained with FIG. 2, and the conditions 2 to 8 correspond to the methods of the invention explained with FIGS. 3 to 9.

As appreciated from FIG. 11, the invention methods can considerably reduce a color registration error. Of these methods, the conditions 2 to 7 provide a small color registration error, and the condition 2 provide the highest precision.

What is claimed is:

1. A registration controlling method comprising the steps of:

charging a belt type photosensitive medium by an electrostatic charger;

forming an electrostatic latent image on the photosensitive medium by an exposure device;

transforming the electrostatic latent image into a toner image by a developer;

transferring the toner image to an intermediate transfer device;

repeating the steps recited above for a plurality color of toner images;

transferring a color toner image formed on the intermediate transfer device to a recording medium;

fixing the recording medium by a fixing device; and ejecting the recording medium out of the apparatus, wherein the photosensitive medium is subjected to exposure by a pre-exposure device during the time period after the start of driving the photosensitive medium and until the front edge of the toner image formed on the photosensitive medium reaches the intermediate transfer device, and during said time period the operation of a cleaner for removing toner on the intermediate device is prohibited for the time required for the intermediate transfer device to rotate at least once or more before the front edge of the toner image reaches the intermediate transfer device.

2. A registration controlling method comprising the steps of:

charging a belt type photosensitive medium by an electrostatic charger;

forming an electrostatic latent image on the photosensitive medium by an exposure device;

transforming the electrostatic latent image into a toner image by a developer;

transferring the toner image to an intermediate transfer device;

repeating the steps recited above for a plurality color of toner images;

transferring a color toner image formed on the intermediate transfer device to a recording medium;

fixing the recording medium by a fixing device; and ejecting the recording medium out of the apparatus, wherein the photosensitive medium is subjected to exposure by a pre-exposure device during the time period after the start of driving the photosensitive medium and until the front edge of the toner image formed on the photosensitive medium reaches the intermediate transfer device, and a cleaner for removing toner on the intermediate device is made operable during the time period after the front edge of the toner image reaches the intermediate transfer device and until the front edge reaches an operating point of said cleaner relative to the intermediate transfer device.

3. A registration controlling method for a color electrophotographic apparatus, comprising the steps of:

charging a belt type photosensitive medium by an electrostatic charger;

forming an electrostatic latent image on the photosensitive medium by an exposure device;

transforming the electrostatic latent image into a toner image by a developer;

transferring the toner image to an intermediate transfer device;

repeating the steps recited above for a plurality color of toner images;

transferring a color toner image formed on the intermediate transfer device t a recording medium;

fixing the recording medium by a fixing device; and ejecting the recording medium out of the apparatus, wherein during the time period after the start of driving the photosensitive medium and until the front end of the toner image formed on the photosensitive medium reaches the intermediate transfer device, a cleaner for removing toner on the intermediate transfer device is made operable during the time period after the front edge of the toner image reaches the intermediate transfer device and until the front edge reaches the operating point of said cleaner relative to the intermediate transfer device.

4. A registration controlling method for a color electrophotographic apparatus, comprising the steps of:

charging a belt type photosensitive medium by an electrostatic charger;

forming an electrostatic latent image on the photosensitive medium by an exposure device;

transforming the electrostatic latent image into a toner image by a developer;

transferring the toner image to an intermediate transfer device;

repeating the steps recited above for a plurality color of toner images;

transferring a color toner image formed on the intermediate transfer device to a recording medium;

fixing the recording medium by a fixing device; and ejecting the recording medium out of the apparatus, wherein during the time period after the start of driving the photosensitive medium and until the front edge of the toner image formed on the photosensitive medium reaches the intermediate transfer device, the photosensitive medium is subjected to exposure by a pre-exposure device.

5. A color electrophotographic apparatus, comprising:

a belt type photosensitive medium;

an electrostatic charger for charging the belt type photosensitive medium;

an exposure device for forming an electrostatic latent image on the photosensitive medium;

a plurality of developers for developing the electrostatic latent image and forming a toner image on the photosensitive medium;

an intermediate transfer device disposed in partial contact with the photosensitive medium for transferring the toner image;

a pre-exposure device for subjected the toner image on the photosensitive medium to exposure immediately before the toner image is transferred to the intermediate transfer device;

a transfer device for transferring the toner image on the intermediate transfer device to a recording medium;

a cleaner detachably mounted on the intermediate transfer device for removing residual toner on the intermediate transfer device; and a fixing device for fixing the toner image on the intermediate transfer device, wherein the photosensitive medium is subjected by the pre-exposure device and the cleaner for removing toner on the intermediate transfer device is made inoperable, during the time period after the start of driving the photosensitive medium and until the front edge of the toner image formed on the photosensitive medium reaches the intermediate transfer device.

6. An image forming apparatus, comprising:

a photosensitive medium;

an electrostatic charger for charging the photosensitive medium;

an exposure device for forming an electrostatic latent image on the photosensitive medium;

a developer for developing the electrostatic latent image and forming a toner image on the photosensitive medium;

an intermediate transfer device disposed near the partial area of the photosensitive medium for transferring thereto the toner image formed on the photosensitive medium by the developer;

a cleaner for removing toner on the transfer device; and a transfer device for transferring the toner image transferred to the intermediate transfer device to a recording medium, wherein said cleaner removes part of toner on the intermediate transfer device before the toner image is transferred to the intermediate transfer device, to the extent that an image other than the image corresponding to the electrostatic latent image is substantially invisible on the recording medium and toner always exists during the image forming operation between the photosensitive medium and the intermediate transfer device.

7. A registration controlling method for a color electrophotographic apparatus, comprising the steps of:

charging a photosensitive medium by an electrostatic charger;

forming an electrostatic latent image on the photosensitive medium by an exposure device;

transforming the electrostatic latent image into a toner image by a developer;

transferring the toner image to an intermediate transfer device;

repeating the steps recited above for a plurality of colors of toner images;

transferring a color toner image formed on the intermediate transfer device to a recording medium;

fixing the recording medium by a fixing device; and ejecting the recording medium out of the apparatus, wherein in order to reduce electrostatic attraction between the photosensitive medium and the intermediate transfer device during transfer of the toner image the photosensitive medium is subjected to exposure by a pre-exposure device located adjacent an image transfer point between the photosensitive medium and the intermediate transfer device during the time period after the start of driving the photosensitive medium and until the front edge of the toner image formed on the photosensitive medium reaches the intermediate transfer device and, during said time period, a cleaner for removing toner on the intermediate transfer device is prohibited from operation.

8. A registration controlling method for a color electrophotographic apparatus, comprising the steps of:

charging a photosensitive medium by an electrostatic charger;

forming an electrostatic latent image on the photosensitive medium by an exposure device;

transforming the electrostatic latent image into a toner image by a developer;

transferring the toner image to an intermediate transfer device;

repeating the steps recited above for a plurality of colors of toner images;

transferring a color toner image formed on the intermediate transfer device to a recording medium; and fixing the recording medium by a fixing device; and ejecting the recording medium out of the apparatus, wherein a cleaner for removing toner on the intermediate transfer device is rendered operative for a first period of time during a time period after the start of driving the photosensitive medium and before the front edge of the toner image formed on the photosensitive medium reaches the intermediate transfer device, said first period of time being equal to a time required for the intermediate transfer device to rotate at least once or more, and wherein, after the first period of time, the cleaner is rendered inoperative for a second period of time sufficient to allow toner to be present on the intermediate transfer device at a transfer point between the photosensitive medium and the intermediate transfer device in order to reduce electrostatic attraction between the photosensitive medium and the intermediate transfer device during transfer of the toner image.

* * * * *